United States Patent [19]

Celette

[11] Patent Number: 4,501,136

[45] Date of Patent: Feb. 26, 1985

[54] DEVICE FOR STRAIGHTENING AUTOMOBILE BODIES OR THE LIKE

[75] Inventor: Germain Celette, Vienne, France

[73] Assignee: Celette S.A., Vienne, France

[21] Appl. No.: 372,314

[22] Filed: Apr. 27, 1982

[30] Foreign Application Priority Data

Mar. 30, 1982 [FR] France ..... 82 05395

[51] Int. Cl.[3] ..... B21D 1/12

[52] U.S. Cl. ..... 72/447; 72/705

[58] Field of Search ..... 72/308, 446, 447, 705; 254/228, 242

[56] References Cited

U.S. PATENT DOCUMENTS

| | | | |
|---|---|---|---|
| 3,269,169 | 8/1966 | Latuff et al. | 72/447 |
| 3,340,720 | 9/1967 | Chartier | 72/705 |
| 3,691,817 | 9/1972 | Friend et al. | 72/705 |
| 3,893,329 | 7/1975 | Roes | 72/705 |
| 3,955,397 | 5/1976 | Meis | 72/705 |

*Primary Examiner*—Lowell A. Larson

*Attorney, Agent, or Firm*—August E. Roehrig, Jr.

[57] ABSTRACT

In a device for straightening vehicle bodies, a long-stroke traction jack is mounted vertically within a vertical column, the jack body being attached to the lower end of the column. The column is carried by a movable base and can be attached to the ground by means of retaining chains. One end of a traction chain passed over a guide pulley and engaged within the interior of the column is attached to the free end of the jack operating rod.

9 Claims, 14 Drawing Figures

9
5
10
F1
43
42
3b
41
13
26
1
3
3a
2
19
38
38
16
17
15
14
20
e
18
4
18

9
8
10
6
7
12
11
5
1

8
11
13
12
10
7
9
6
13

9
5
10
3b
35
3a
F3
2
38
38
31
17
15
37
34
36

DEVICE FOR STRAIGHTENING AUTOMOBILE BODIES OR THE LIKE

The present invention relates to devices employed for straightening bodies of automobiles or the like.

More specifically, the invention relates to devices of the type consisting of a vertical column carried by a movable base, a jack being mounted on said column in order to produce action on a traction chain which is intended to be attached to the vehicle body to be straightened. Devices of this type are described in particular in U.S. Pat. Nos. 3,340,720 and 3,888,100.

The jack provided in these devices consists of a vertically disposed thrust jack in which the movable operating rod has a head on which the traction chain is fixed at the opposite end of this latter with respect to the end attached to the vehicle body to be straightened. Said chain passes first over a guide pulley carried by a collar, the position of which can be changed in the vertical direction on the column of the device. Thus the movement of extension of the thrust jack applies a tractive force on the chain which is attached to the vehicle body to be straightened. If so required, the traction chain may not necessarily be fixed directly on the top head of the thrust jack but may be passed over a second guide pulley provided on said head and may be attached to a fixed point of the column of the device.

Devices of this type are relatively convenient to use but are attended by a certain number of disadvantages. Among other things, it is necessary to make provision at the upper end of the vertical column for a guide ring machined to a high degree of accuracy in order to guide the operating rod of the thrust jack without any play. Furthermore, there is a potential danger of buckling of the operating rod and this makes it necessary to adopt overdimensioning of this latter and of the vertical column in order to forestall such a danger. Furthermore, there is considerable friction of the operating rod of the jack within the top guide ring, thus resulting in a substantial loss of power in the tractive effort which is actually exerted.

Moreover, if one or a number of extensions are adapted on the upper end of the vertical column for certain predetermined types of bodywork operations, provision must be made for extremely efficient locking of said extensions since these latter would otherwise be pulled loose during operation of the device.

Furthermore, when provision is made for reeving of the chain on the vertical column by passing the corresponding end over a pulley for guiding and fixing on said column, the pulley thus provided is subjected to high friction forces. Moreover, it is necessary to make use of a jack whose power is greater than double the tractive force which it is desired to exert on the vehicle body to be straightened. This is therefore a cause of the higher capital cost of devices of this type.

For this reason, the aim of the present invention is to provide a straightening device which is of the same general type but is so designed as to circumvent the disadvantages set forth in the foregoing.

To this end, the jack provided in this device consists of a vertically mounted long-stroke traction jack whose body is attached to the bottom of the vertical column whilst the traction chain engages within the interior of the column after having passed over a guide pulley located at the upper end of said column and the end of the chain is secured to the free end of the jack operating rod.

Thus said jack produces direct action on the traction chain and the tractive force which is actually exerted on the vehicle body to be straightened has substantially the same value as the power of the jack employed. Under these conditions, it is possible to make use of a jack having lower power than in the devices mentioned earlier. Furthermore, it serves no useful purpose to provide a special guiding element at the upper end of the column since it is only necessary to leave a free passage for the traction chain, the end of which is directly attached to the operating rod of the actuating jack.

It is worthy of note in this connection that, according to another distinctive feature of the device under consideration, the jack body and operating rod are free within the interior of the vertical column of the device and the lower end of the jack body is attached to said column by means of an articulation or the like. Thus the jack is capable of freely assuming the desired orientation so as to ensure that the tractive force is exerted in a straight line, thereby removing the disadvantages which could result from faulty alignment.

According to another feature of the device under consideration, the base of the vertical column has a horizontal bottom wall which extends at a short distance above the ground and said base is mounted on runner-wheels with interposition of resilient pads. Thus, at the time of utilization of the device, the reaction force exerted on the base ensures that the bottom wall of this latter is applied against the ground as a result of compression of said resilient pads. This feature has a contributory effect in ensuring that the device is perfectly maintained in a stationarily fixed position whilst the column is also held in position by means of two or more chains which are attached to anchoring points provided in the ground.

In one advantageous embodiment of the device, the traction jack body is slidably mounted in the vertical direction on its pivot-pin which is carried by the column of the device and a retaining chain passed over a guide pulley is then fixed on the lower end of said jack body. Said chain is intended to be attached at the opposite end either to the upper end of the vertical column or to a collar mounted on said column and adapted to carry a guide pulley for the traction chain. This arrangement makes it possible to obtain automatic balancing between the forces exerted on the device.

Other features of the invention will be more apparent to those skilled in the art upon consideration of the following description and accompanying drawings, wherein.

Figure 1:
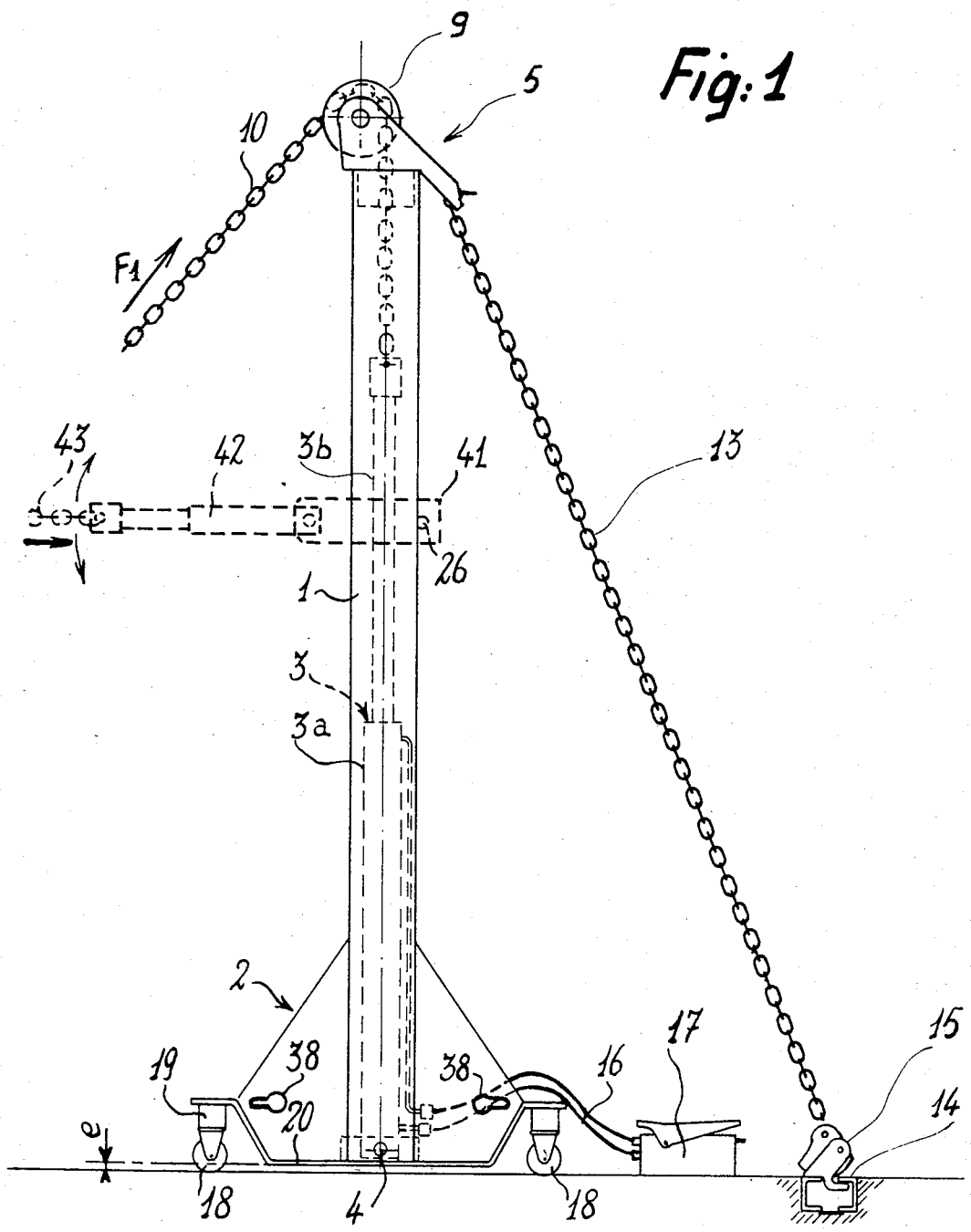
FIG. 1 is a side view in elevation showing a first embodiment of the device under consideration.

In the example of construction shown in FIGS. 1 to 7, the device according to the invention comprises a vertical column 1 carried by a movable base 2. There is placed within said column a hydraulic traction jack 3 having a long stroke and disposed vertically. The lower end of the jack body 3*a* is attached to the corresponding end of the vertical column 1 by means of a pivot-pin 4. Thus the jack body and the operating rod 3*b* of said jack are capable of free orientation within the interior of the column 1.

Said column has either a square or rectangular cross-section. An end-piece 5 having the same cross-section is forcibly fitted within the upper end of said column and provided with an end plate 6 in which is formed an opening 7. Said plate is adapted to carry a yoke 8 within which is mounted a guide pulley 9. A traction chain 10 passes over said pulley and one end of said chain is intended to be attached to the vehicle body to be straightened. The opposite end of said chain passes into the interior of the vertical column 1 through the opening 7 of the top end-piece 5 so as to be fixed on the free end of the operating rod 3*b* of the traction jack.

Figure 2:
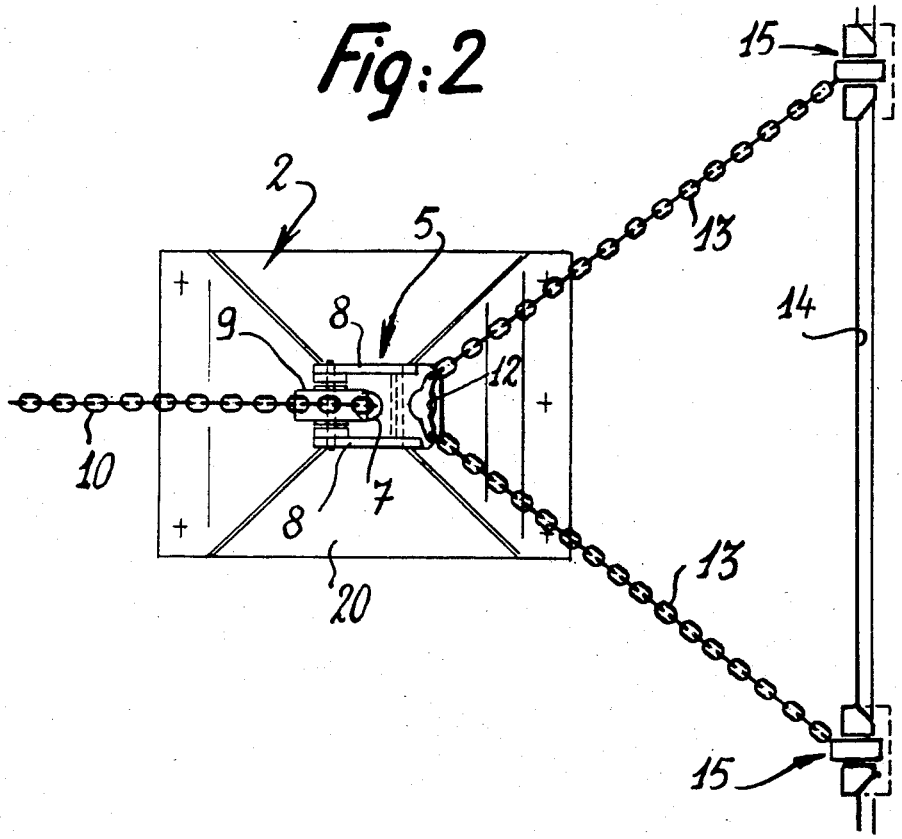
FIG. 2 is an overhead plan view.

The end plate 6 of the end-piece 5 has an elbowed extension 11 in which is formed an opening 12 provided with slots in order to permit the attachment of two retaining chains 13 as shown in FIGS. 1 and 2. The opposite ends of said chains are attached to anchoring points provided in the ground. In order to permit positioning of the device in various positions around the vehicle body to be straightened, sectional members 14 are sunk in the ground and surround the intended location of said vehicle body. The retaining chains are attached to said sectional members by means of positionally adjustable fastening devices 15.

As has already been mentioned, the actuating jack 3 is a hydraulic long-stroke traction jack. Said jack is controlled by a valve 17 provided with an operating pedal.

However, the return of the operating rod 3*b* of said jack to the raised rest position shown in FIG. 1 is effected by delivering air under pressure against the opposite face of the piston via a pipe 16 which is also controlled by the valve 17. It is thus possible to obtain a rapid return of the operating rod 3*b* to its inactive raised position.

The movable base 2 rests on runner-wheels which facilitate its displacement. By way of example, provision is made for six runner-wheels 18 of which three are provided beneath one of the raised edges of said base and three others are provided beneath the opposite raised edge. However, said base is mounted on each runner-wheel with interposition of a resilient pad 19. In addition, said base has a flat bottom wall 20 which extends at a small height e above the ground.

Figure 5:
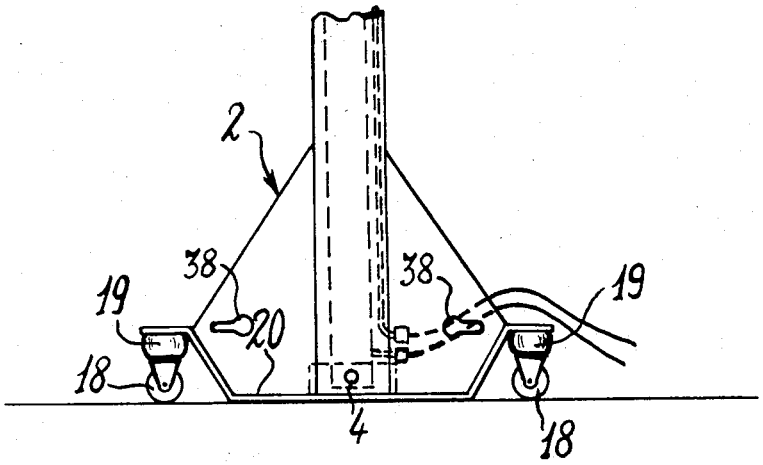
FIG. 5 is a fragmentary view in elevation illustrating the base of said device which is applied against the ground under utilization conditions.

Under these conditions, at the time of utilization of the device, the reaction force exerted on the base causes compression of the resilient pads 19 and consequently applies the bottom wall 20 of said base against the ground as shown in FIG. 5. The effect thereby achieved is that the base is applied directly against the ground and thus prevents any danger of damage to the runner-wheels and their assembly parts. A further contributory effect is to ensure that the device is maintained perfectly stationary during use in addition to the retaining action already produced by the chains 13 which are provided for this purpose.

By means of the device contemplated by the invention, a vehicle body to be straightened can accordingly be subjected to high tractive forces under the best possible conditions of use and safety. The chain 10 which passes over the guide pulley 9 located at the upper end of the column 1 can then be attached directly at a suitable point of the vehicle body so as to exert an oblique upward tractive force in the direction of the arrow F1 as shown in FIG. 1. By reason of the fact that said chain 10 is fixed directly on the movable operating rod 3*b* of the traction jack, it is only necessary to provide a jack having a power which is very slightly higher than the force which it is desired to exert on the vehicle body to be straightened.

A further advantage of this device lies in the fact that there is no need to provide any particular guiding member at the upper end of the vertical column 1 and that the traction jack 3 can be freely oriented by pivotal displacement about the pin 4. The jack can thus assume the required orientation in order to apply traction in a straight line, thus avoiding the disadvantages of any possible misalignment.

Yet another advantage lies in the fact that the end-piece 5 which carries the top guide pulley 9 is maintained on the upper end of the vertical column as a result of the pressure exerted on said pulley by the traction chain 10. This makes it possible in addition to provide for removable mounting of said end-piece so as to permit reversal in situ for a particular purpose which will be explained hereinafter in greater detail.

Figure 6:
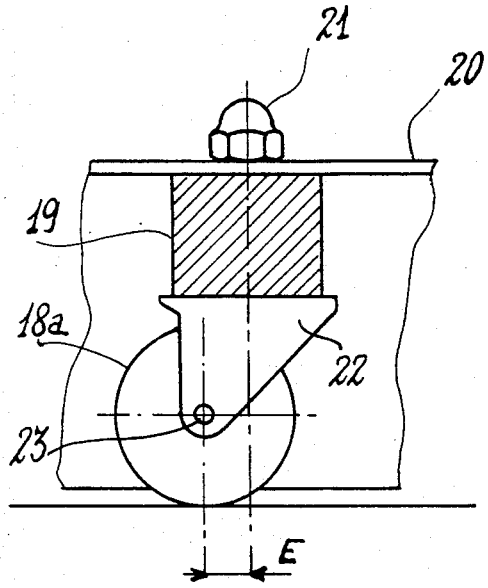
FIGS. 6 and 7 are fragmentary views in elevation representing a particular mode of assembly of the runner-wheels of the base of said device, the view of FIG. 7 being intended to illustrate the conditions under which said base bears on the ground at the time of utilization of the device.
Figure 7:
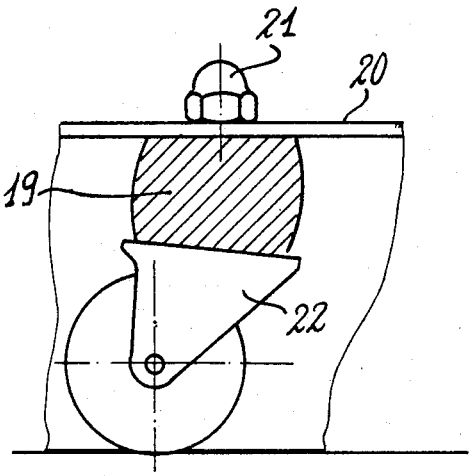

FIGS. 6 and 7 illustrate a particular mode of assembly of the base runner-wheels of the device. In this case, the arrangement is such that the vertical axis of the fastening bolt 21 of the yoke 22 of each corresponding runner-wheel 18*a* is relatively displaced over a distance E with respect to the position of the horizontal axis 23 of said runner-wheel. As in the preceding embodiment, however, a resilient pad 19 is interposed between the top surface of the yoke 22 and the base 20 of the device.

Under these conditions, the reaction force exerted on said base at the time of utilization of the device tends to cause the yoke 22 of each runner-wheel to undergo a pivotal displacement as shown in FIG. 7 while causing compression of the resilient pads 19. As in the previous example, the result thereby achieved is that the bottom wall 20 of the base 2 is applied directly against the ground throughout the period of utilization of the device.

Figure 9:
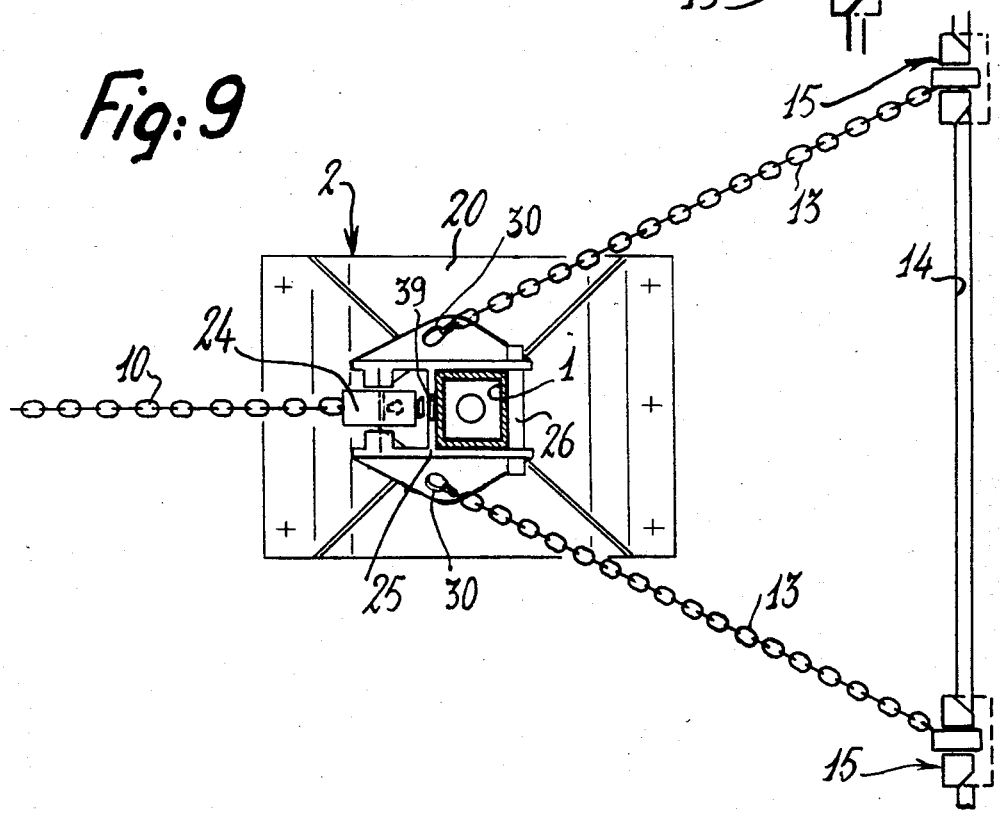
FIG. 9 is a sectional view taken along line IX—IX of FIG. 8.
Figure 3:
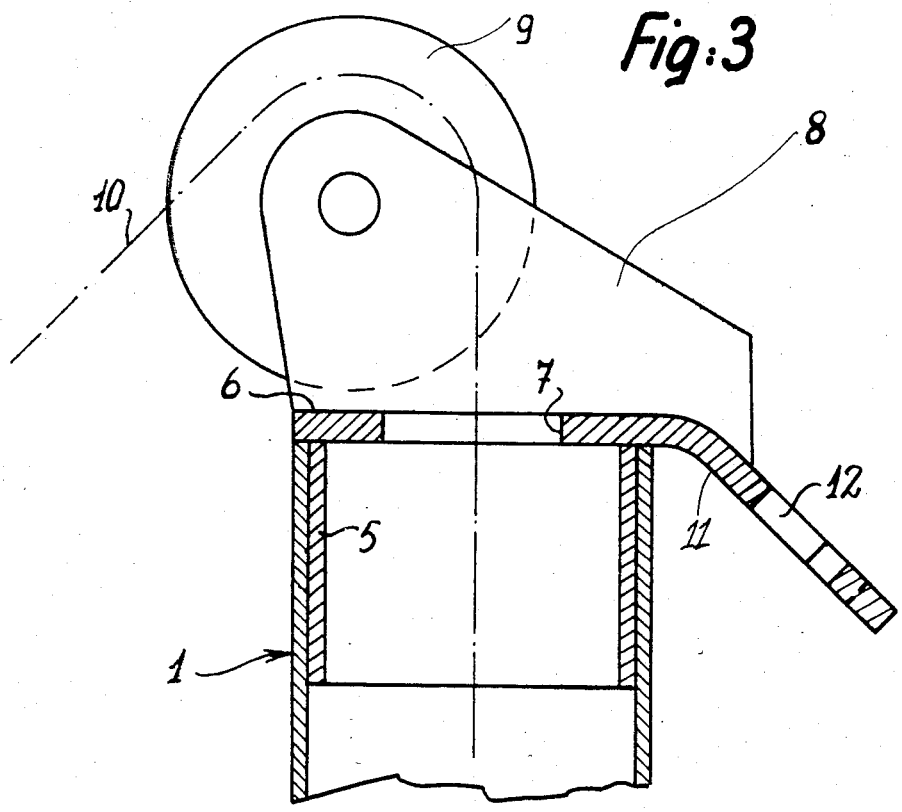
FIG. 3 is a fragmentary view in elevation to a different scale and showing the upper end of the column of the device under consideration.
Figure 4:
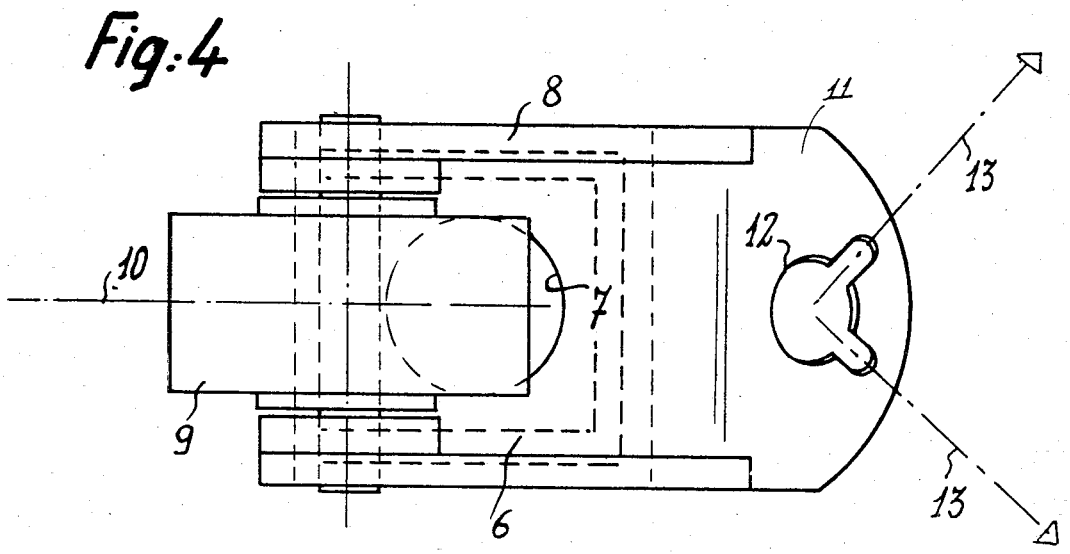
FIG. 4 is an overhead plan view drawn to the same scale.
Figure 8:
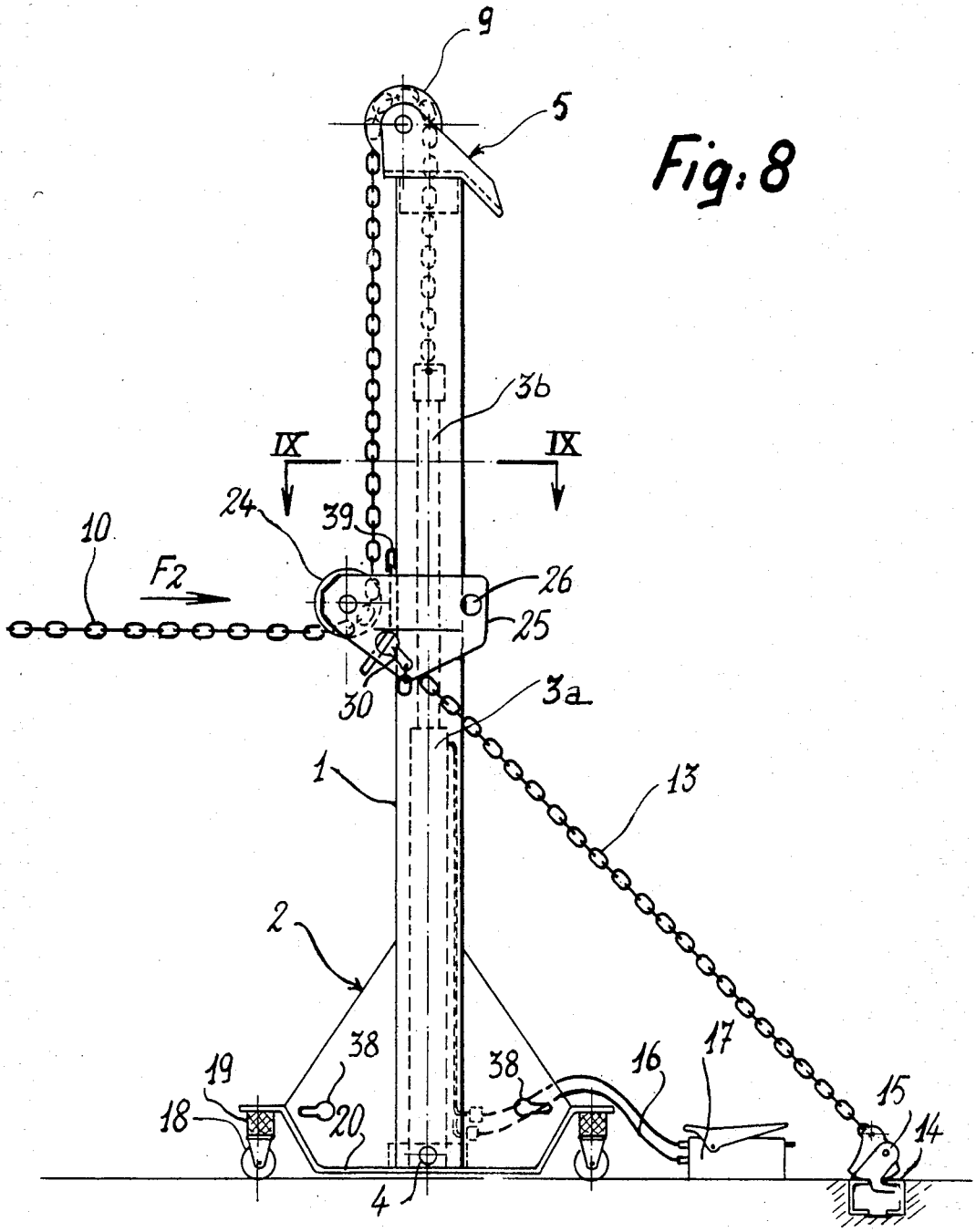
FIG. 8 is a view in elevation illustrating another embodiment of this device.
Figure 8A:
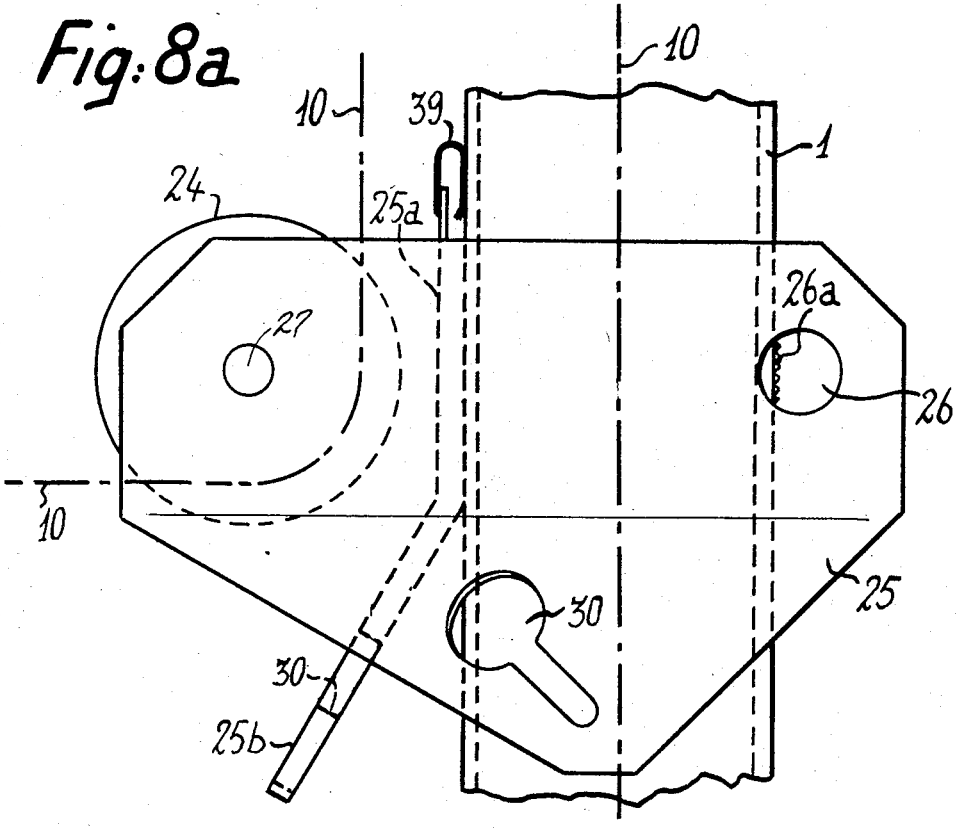
FIG. 8A is a detail view in elevation to a different scale.
Figure 9A:
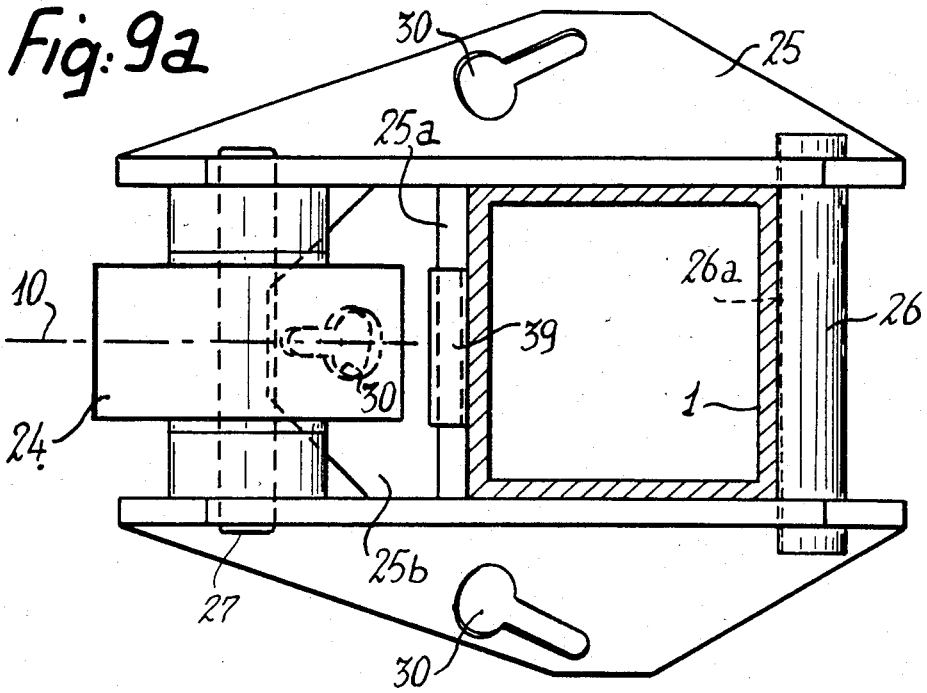
FIG. 9A is a sectional view on the same section plane as FIG. 9 but to a different scale.

FIGS. 8 and 9 illustrate another embodiment of the device shown in FIGS. 1 to 5. In the case thus illustrated, it is intended to apply a tractive force in a horizontal direction F2 on the vehicle body to be repaired.

To this end, provision is made for an additional guide pulley 24 carried by a collar 25 which is removably mounted on the column 1. The chain 10 is then engaged around said pulley as shown in FIG. 8 before passing over the top guide pulley 9 already mentioned. The collar 25 is mounted so as to permit displacement in sliding motion along the column 1. The position of said collar can thus be modified in order to place this latter in the desired position for ensuring that the working end of the chain 10 extends horizontally as shown in FIG. 8. However, provision is made for a suitable locking system for maintaining the collar 25 in a stationary position at the desired level.

Moreover, the collar 25 is preferably detachable in order that it may be rapidly placed in position on the column 1 or withdrawn from the column if it is desired to adopt the arrangement of the device which is illustrated in FIGS. 1 and 2. To this end, said collar is actually designed in the form of a yoke, the two cheeks of which are joined together by means of a detachable locking-pin 26 on the side opposite to the end wall 25*a* of said yoke and to the guide pulley 24. Thus it is only necessary to remove said locking-pin in order to permit easy withdrawal of the collar 25.

Said locking-pin is applied against the corresponding face of the column 1 by means of a flat surface on which provision is made for gripping teeth or ribs 26*a*.

On the opposite side, the end wall 25*a* of the yoke 25 is adapted to carry a spring 39 which is applied against the corresponding face of the column 1, thus ensuring that the collar 25 can be locked in position at the desired level. However, any other suitable system could be provided for locking the collar 25 in the position which is chosen.

In order to facilitate positioning of the traction chain 10 around the pulley 24, it is preferably ensured that said pulley is also detachable and that the spindle 27 of this latter is removable.

In the particular case illustrated in FIGS. 8 and 9, the retaining chains 13 are attached to the collar 25 and not to the top end-piece 5. To this end, the two side cheeks of said collar are provided with buttonhole slots 30 for receiving the corresponding ends of said chains as shown in FIGS. 8 and 9. In addition, the end wall 25*a* of the yoke which constitutes the collar 25 has a downward extension 25*b* in which is also formed a buttonhole slot 30. By means of said slot, other retaining chains extending in a direction opposite to the chains 13 can be anchored to the ground. These additional anchoring chains are necessary for carrying out certain types of bodywork.

Figure 10:
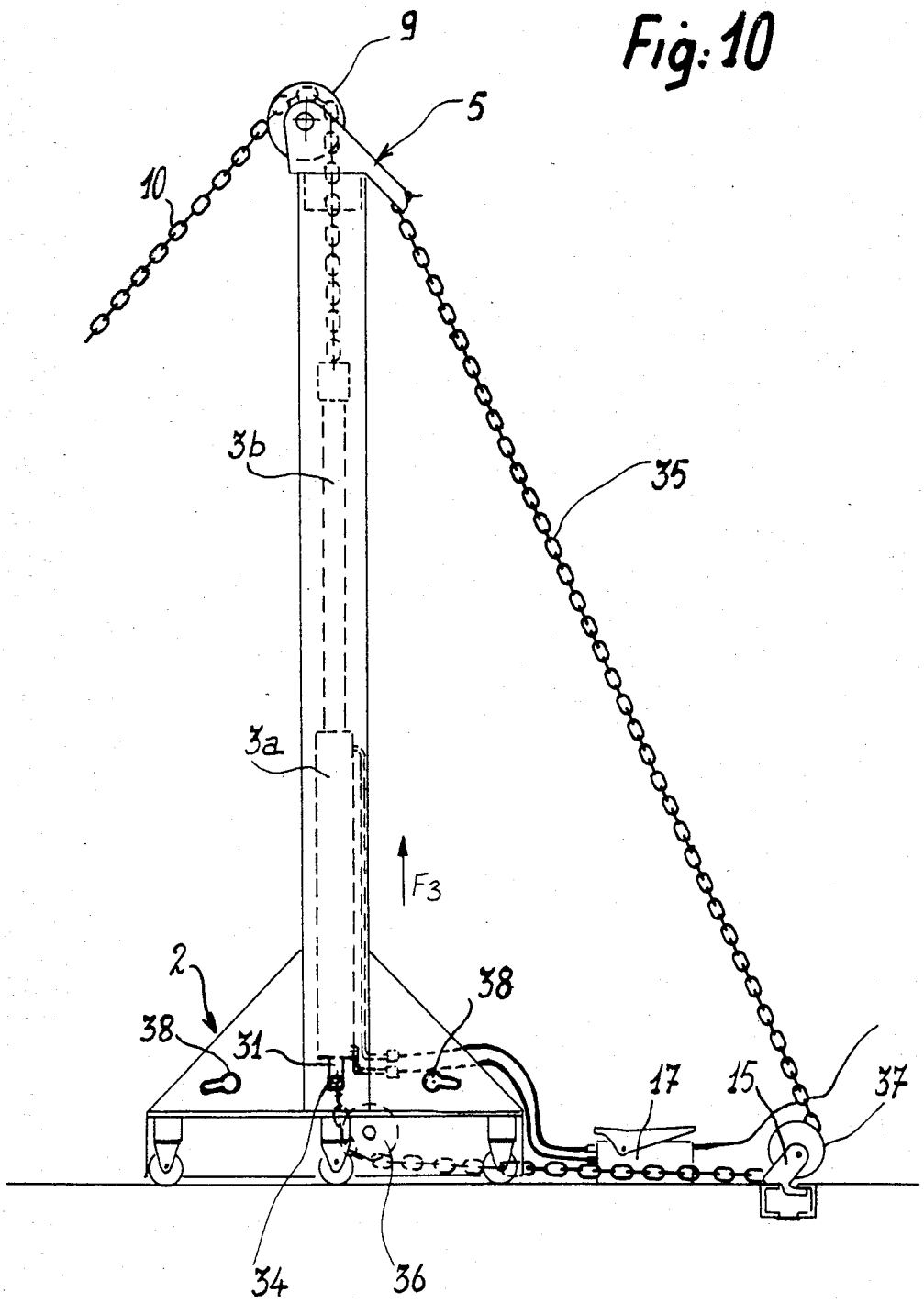
FIG. 10 is a view in side elevation of a embodiment of the device under consideration.
Figure 11:
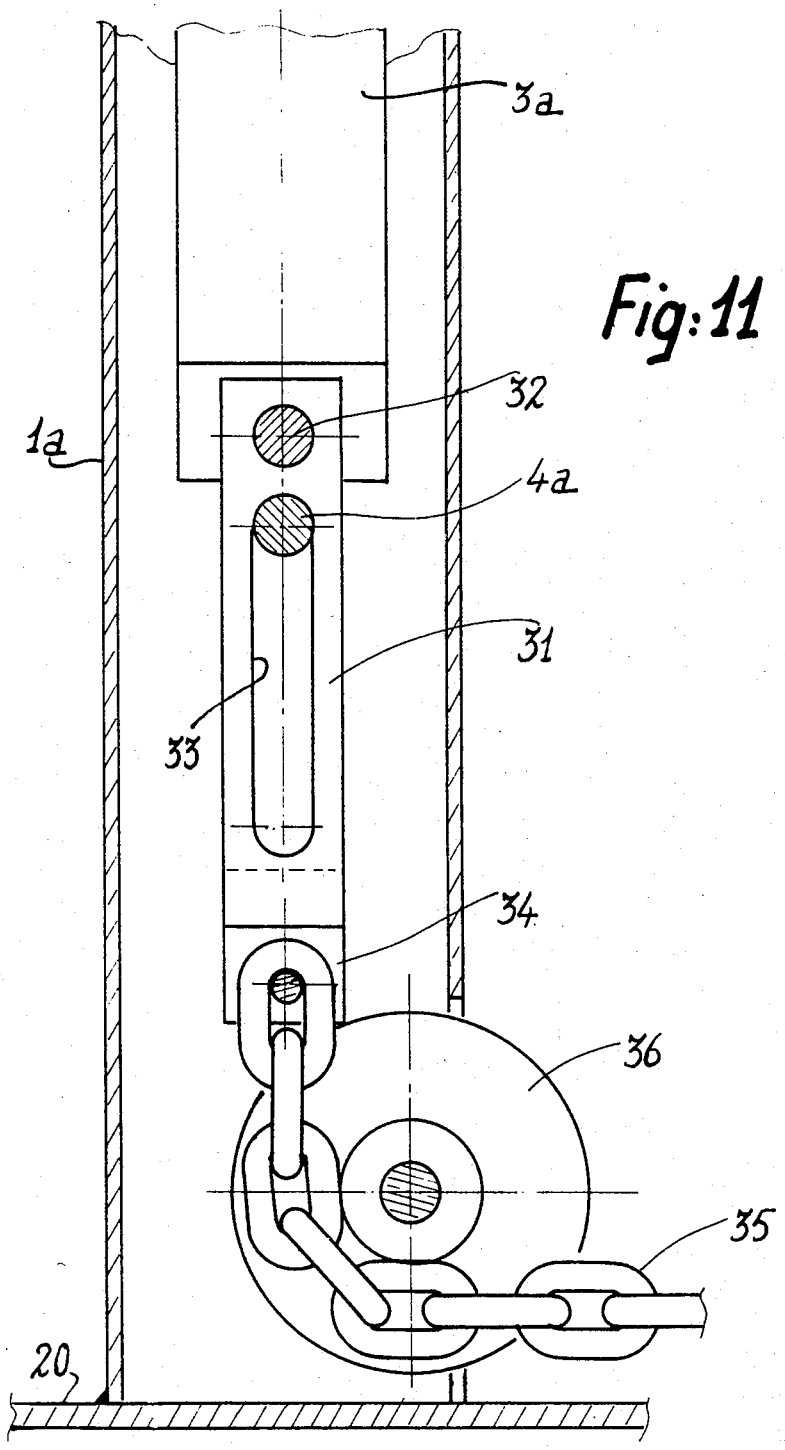
FIG. 11 is a fragmentary sectional view to a different scale and showing the lower end of said device.

FIGS. 10 and 11 illustrate another embodiment of the device according to the invention which is employed in the same manner as in the case of FIGS. 1 and 2. This embodiments differs from the preceding embodiment in the fact that the traction jack body 3*a* is capable of displacement over a predetermined distance in the vertical direction with respect to its corresponding pivot-pin 4*a*. With this objective, the lower end of the jack body 3*a* is adapted to carry a vertical arm 31 which can be fixed by means of a second pivot-pin 32 and is provided with an elongated slot 33 within which is engaged the pivot-pin 4*a*.

The lower end of said arm is adapted to carry a yoke 34 in which is attached a retaining chain 35. Said chain passes over a guide pulley 36 provided at the lower end of the vertical column 1*a* of the corresponding device. In the case of utilization illustrated in FIG. 10, said retaining chain is placed above the ground so as to be engaged around a second guide pulley 37 carried by one of the devices 15 for anchoring to the ground. Said chain then extends obliquely upwards and its corresponding top end is attached to the top end-piece 5 of the vertical column. Said top end is then attached within the hole 12 of the end-piece extension 11, two normal retaining chains 13 being disposed on each side.

Thus said chain 35 constitutes one of the retaining chains of the device.

In the state of rest, the pivot-pin 4*a* of the jack body is located at the upper end of the elongated slot 33 formed in the coupling arm 31. When the device is put into operation, the reaction force applied to the jack body tends to cause lifting of this latter in the direction of the arrow F3. By reason of the mode of assembly which is contemplated in this case, said jack can accordingly be displaced in the upward direction. However, this movement is stopped by the retaining chain 35 when an equilibrium is established between the forces applied to the device. In consequence, automatic balancing of said forces is therefore obtained.

Figure 12:
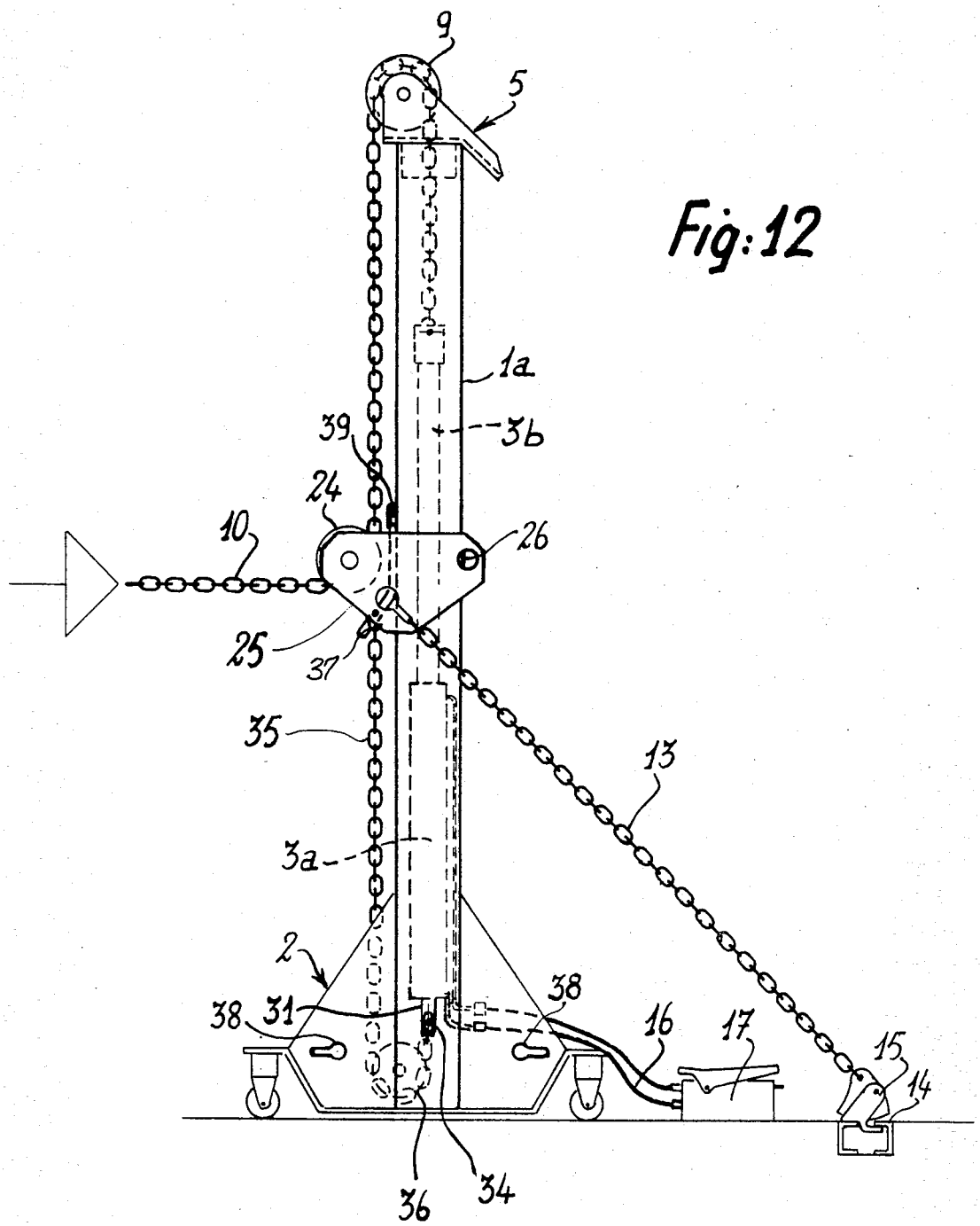
FIG. 12 is a view in elevation illustrating another embodiment of the same device.

FIG. 12 illustrates another embodiment of the device shown in FIGS. 10 and 11. This embodiment is comparable with the embodiment illustrated in FIGS. 8 and 9. In fact, the collar 25 which carries the additional guide pulley 24 is placed on the vertical column 1*a* in this particular case in such a manner as to ensure that the working end of the traction chain 10 extends in the horizontal direction.

In this case, the retaining chain 35 which is fixed on the bottom coupling arm 31 of the jack body is attached to said collar at the opposite end, at a point 37. However, this mode of assembly can be carried out in practice only by reversing the top end-piece 5 in order to ensure that its guide pulley 9 is located on the same side as the bottom guide pulley 36 provided at the lower end of the column 1*a*. In the same manner as in the FIGS. 8 and 9, the device is retained in position in this case by two chains 13 disposed in a V and attached to the collar 25. However, by virtue of the particular arrangement of the jack body and its retaining chain 35, balancing of the forces applied to the device is obtained automatically.

As shown in FIG. 1, provision can be made for an additional collar 41 which can be mounted on the column 1 in the same manner as the collar 25. Said collar 41 is intended to permit adaptation of a traction jack 42 to which is attached a chain 43.

In addition, provision is made for extension sections (not shown) which are intended to be added to the upper end of the column 1 after withdrawal of the top end-piece 5, said end-piece being subsequently added to the upper end of the last extension section. It is worthy of note that, by this means, said extension or extensions are perfectly maintained in position on the upper end of the column 1 as a result of the pressure exerted by the traction chain 10 on the pulley 9 of the end-piece 5. It is therefore unnecessary to provide a special system for locking the extension sections on the column 1.

The base 2 is preferably provided with holes 38 for the attachment of retaining chains which are intended to be anchored in the ground, anchoring being necessary for carrying out certain special types of repair work.

However, many other modifications and alternative forms of construction of the device according to the invention could be contemplated.

What is claimed is:

1. A device for straightening vehicle bodies comprising a vertical column having a guide pulley supported at an upper end thereof and being carried upon a movable base, a traction jack vertically disposed within said vertical column and having a body portion and an operating rod extending from said body portion, a traction chain for connection to the vehicle to be straightened when applying a straightening force to the vehicle body, said traction chain having one end coupled within the interior of said vertical column to the operating rod of said traction jack and another end passing out from the interior of said vertical column over said guide pulley supported at the upper end thereof for connection to the vehicle body upon which a straightening force is to be applied, a collar carried on said vertical column and selectively positionable in a vertical direction relative thereto, said collar including a guide pulley positioned to engage said traction chain for applying a straightening force to the vehicle body in a predetermined direction at a vertical height determined by the selective positioning of said collar, a first retaining means engageable with said collar for attaching said device to the ground to secure said device in a fixed position while applying a straightening force to a vehicle body, said movable base including a guide pulley supported thereby with a second retaining means passing thereabout, said second retaining means being secured at one end to said collar and at an opposite end to said body portion of said traction jack, said device being movable about the vehicle body to be straightened, free from any connection therewith other than said traction chain for applying a straightening force thereto, said movable base upon which said vertical column is carried having a horizontal bottom wall which is disposed a short distance above the ground, and runner wheels carried by said movable base and having resilient pads positioned between said movable base and said runner wheels so that upon application of a straightening force to the vehicle through said traction chain, said horizontal bottom wall will compress said resilient pads and contact the ground to enhance the stability of the device during use.

2. A device according to claim 1, wherein said guide pulley carried by said collar is in turn removably mounted on said collar.

3. A device for straightening vehicle bodies comprising a vertical column having a guide pulley supported at an upper end thereof and being carried upon a movable base, said guide pulley being carried by an end piece which is fitted within said vertical column and can be withdrawn therefrom and reinserted in a reverse position, retaining means supported from said vertical column for attaching said device to the ground to secure said device in a fixed position while applying a straightening force to a vehicle body, a traction jack vertically disposed within said vertical column and having a body portion attached to the bottom of said vertical column and an operating rod extending from said body portion, a traction chain for connection to the vehicle to be straightened when applying a straightening force to the vehicle body, said traction chain having one end coupled within the interior of said vertical column to the operating rod of said traction jack and another end passing out from the interior of said vertical column over said guide pulley supported at the upper end thereof for connection to the vehicle body which a straightening force is to be applied, said device being movable about the vehicle body to be straightened, free from any connection therewith other than said traction chain for applying a straightening force thereto, said movable base upon which said vertical column is carried having a horizontal bottom wall which is disposed a short distance above the ground, and runner wheels carried by said movable base and having resilient pads positioned between said movable base and said runner wheels so that upon application of a straightening force to the vehicle through said traction chain, said horizontal bottom wall will compress said resilient pads and contact the ground to enhance the stability of the device during use.

4. The device of claim 3 wherein said retaining means is supported at the upper end of said vertical column.

5. The device of claim 23 further including a collar carried on said vertical column and selectively positionable in a vertical direction relative thereto, said collar including a guide pulley positioned to engage said traction chain for applying a straightening force to the vehicle body in a predetermined direction at a vertical height determined by the selective positioning of said collar.

6. The device of claim 5 wherein said collar encircles said vertical column and has a portion thereof detachable from the remainder of said collar to free said collar from engagement with said vertical column to facilitate rapid positioning thereupon and removal therefrom.

7. The device of claim 5 wherein said retaining means is secured to said collar.

8. The device of claim 3 wherein said traction jack is double-acting to positively move said operating rod in to an out from said body portion.

9. A device for straightening vehicle bodies comprising a traction chain coupled to a jack mounted within a vertical column carried by a movable base and intended to be attached to the ground by means of at least two retaining chains, wherein the jack is a vertically-disposed long-stroke traction jack whose body is attached to the bottom of the column of the device whilst the traction chain engages within the interior of the column after having passed over a guide pulley located at the upper end of said column and the end of the chain is secured to the free end of the jack operating rod, the traction jack body and operating rod being free within the interior of the vertical column of the device and only the lower end of the jack body being attached to said column so that said jack may thus be capable of freely assuming the desired orientation in order to apply the tractive force in a straight line and prevent any misalignment, the traction jack body being slidably mounted in the vertical direction on a pivot-pin which is carried by the column of the device, and a retaining chain passing over a guide pulley and secured at one end to the lower end of said jack body, said chain being secured at its other end to a stationary portion of said device.

* * * * *

UNITED STATES PATENT AND TRADEMARK OFFICE

CERTIFICATE OF CORRECTION

PATENT NO. : 4,501,136

DATED : February 26, 1985

INVENTOR(S) : Germain Celette

It is certified that error appears in the above-identified patent and that said Letters Patent is hereby corrected as shown below:

Column 8, line 27, "23" should be --3--.

Signed and Sealed this

*Twenty-fifth* Day of *June 1985*

[SEAL]

*Attest:*

DONALD J. QUIGG

*Attesting Officer*

*Acting Commissioner of Patents and Trademarks*